United States Patent [19]

Collum, Jr.

[11] 4,325,154

[45] Apr. 20, 1982

[54] SURFBOARD FIN

[76] Inventor: William E. Collum, Jr., Millstone Dr., Southampton, N.Y. 11968

[21] Appl. No.: 135,500

[22] Filed: Mar. 31, 1980

[51] Int. Cl.[3] ..... A63C 15/05

[52] U.S. Cl. ..... 441/74; 114/127; 114/140; 441/79

[58] Field of Search ..... 9/310 E; 114/140, 126–139

[56] References Cited

U.S. PATENT DOCUMENTS

| | | | |
|---|---|---|---|
| 2,980,049 | 4/1961 | Ward et al. | 114/140 |
| 3,324,815 | 6/1967 | Morales | 114/126 |
| 3,516,099 | 6/1970 | Morey et al. | 9/310 E |
| 3,564,632 | 2/1971 | Bahne, Jr. | 9/310 E |
| 3,585,663 | 6/1971 | Johnson | 9/310 E |
| 3,965,514 | 6/1976 | Shafer et al. | 9/310 E |
| 4,029,037 | 6/1977 | Hogan | 114/127 |
| 4,044,416 | 8/1977 | Brewer et al. | 9/310 E |
| 4,209,867 | 7/1980 | Abrams | 9/310 E |

FOREIGN PATENT DOCUMENTS

| | | | |
|---|---|---|---|
| 1278870 | 9/1968 | Fed. Rep. of Germany | 114/138 |

*Primary Examiner*—Trygve M. Blix
*Assistant Examiner*—C. T. Bartz
*Attorney, Agent, or Firm*—Marvin Feldman; Stephen E. Feldman

[57] ABSTRACT

A surfboard fin is disclosed which is formed of shaped plastic opposed members which are joined and sealed to form a hollow light-weight buoyant construction, which provides an external contour to reduce drag in surfboarding. The novel profiled plastic surfboard fin is readily mounted to conventional boards and replaces the present conventional fiberglass fins.

11 Claims, 4 Drawing Figures

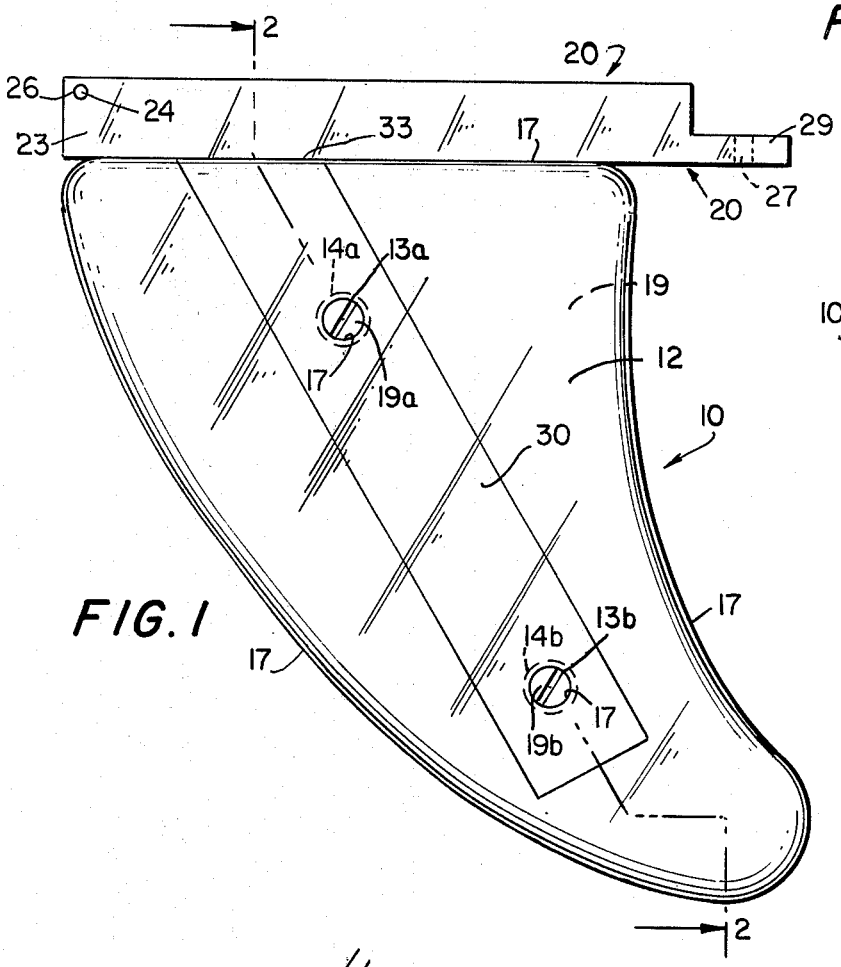
FIG. 1
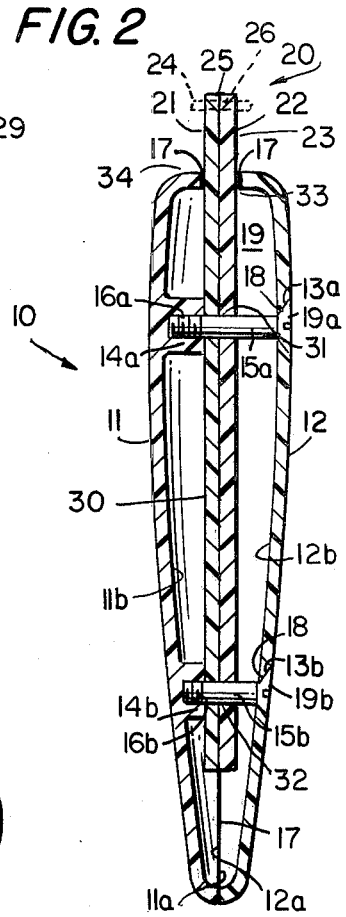
FIG. 2
FIG. 3A
PRIOR ART
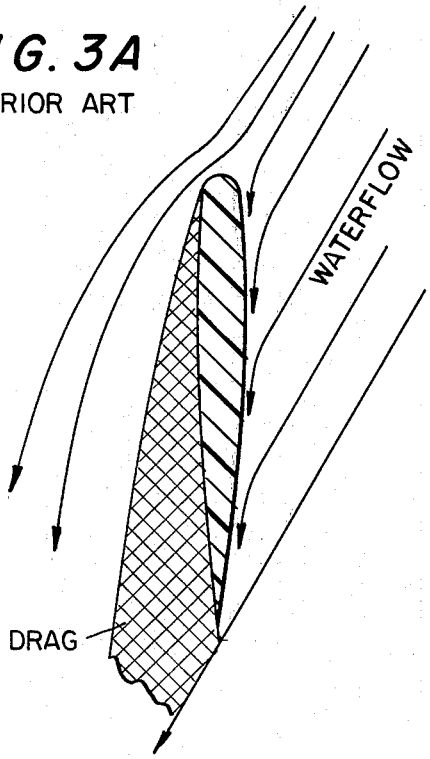
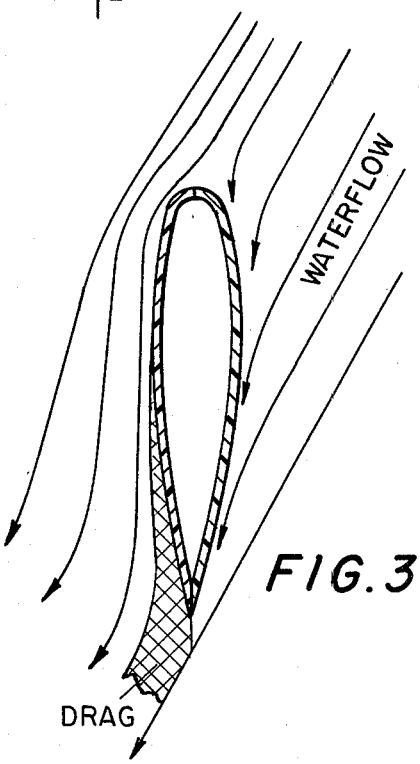
FIG. 3B

SURFBOARD FIN

FIELD OF THE INVENTION

This invention relates to surfboard fins. Specifically, this invention relates to improvements in surfboard fin design and construction.

BACKGROUND AND DISCUSSION OF THE PRIOR ART

Heretofore conventional surfboards and the surfboard fins were constructed of laminated fiberglass which provided the desired strength under the stress and exposure of surfing environments. Such fiberglass fins were of a sharp profile which caused considerable drag effect in surfing. In addition, the weight of such fins was more than was desired by most surfers.

In an attempt to overcome these drawbacks, the prior art sought to hand-shape balsa wood so as to be contoured to reduce drag, and be within the weight control limits desired by surfers. Principal drawbacks of the balsa wood fins were the cost of hand-shaping to the desired contour, as well as its lack of structural integrity, particularly so with long term use. As a consequence, such fins were used by only a small minority of the surfing population.

Now there is provided by the present invention a surfboard fin which is shape-contoured to reduce drag, while being of light-weight and buoyant construction, and yet is readily manufactured.

It is therefore a principal object of the present invention to provide a surfboard fin which alleviates one or more of the problems attendant to the aforesaid prior art fins.

It is another object of the present invention to provide a surfboard fin as aforesaid which combines the desired attributes of low drag, light-weight, high strength and buoyancy, and yet is readily manufactured.

It is a further object of this invention to provide a surfboard fin which may readily be permanently decorated and has an aesthetically desirable appearance.

It is a still further object of this invention to provide a surfboard fin which is of practical design and readily mounted to conventional surfboards.

The aforesaid as well as other objects and advantages as will become apparent from a reading of the following description, the adjoined claims and the drawings.

IN THE DRAWINGS

FIG. 1 is a side elevational view of the fin of the present invention;

FIG. 2 is a sectional view taken along line 2—2 of FIG. 1; and

FIGS. 3A and 3B show a comparison of the profiles of the prior art fin with that of the present invention.

DESCRIPTION OF THE PREFERRED EMBODIMENT

Referring to FIGS. 1 and 2 there is shown the surfboard fin of the present invention generally referred to by numeral 10. Fin 10 comprises two opposed shaped, thermoplastic members 11 and 12. The members are preferably formed of clear translucent polycarbonate, such as Lexan. ("Lexan" is a registered trademark of the General Electric Co., Schnectady, N.Y.). Members 11 and 12 are molded in a pair of shaped contours so when joined to provide a low drag profile as shown in FIG. 3B.

Member 12 is formed with two counter-bores 13*a* and 13*b* while member 11 is formed with a threaded female members 14*a* and 14*b*, and where female members 14*a* and 14*b* and counterbores 13*a* and 13*b* are respectively coaxial when members 11 and 12 are in mating contact relationship as shown. Screws 15*a* and 15*b* pass through respective counterbores 13*a* and 13*b* and engage recess threads 16*a* and 16*b* of female members 14*a* and 14*b*. With the tightening of screws 15*a* and 15*b*, the respective edges 11*a* and 12*a* of members 11 and 12 are brought into abutting pressing contact. A silicone sealant 17 is applied to edges 11*a*, 12*a*, as well as at 18 within the counterbores and on screw heads 19*a* and 19*b*. Sealant 17 is also applied to all mating edges so that the fin is fluid tight. In this manner of construction the joined and sealed members form a hollow cavity 19 so as to render the fin buoyant.

The connecting or mounting member 20 comprises a pair of cut stock members 21 and 22 which are glued together as at 25 so as to form an integral piece. The top rectilinear portion 23 of member 20 is sized to be slidably mounted in a surfboard undergroove (not shown) in the conventional manner. A metal stud 24 is fixedly glued in to transverse hole 26, whereby the stud releasably interconnects to the surfboard in the conventional manner. A second hole 27 is formed at the tail 29 of member 20 and serves as a tie hole for the connecting strap (not shown) which is worn by many surfers to prevent loss of the surfboard.

Member 20 is formed with a depending portion 30 extending downwardly from portion 23 and is formed with two transverse holes 31 and 32 for slidably accommodating screws 15*a* and 15*b*, respectively. Portion 30 passes through slot 33 formed at the top 34 of the abutting members, and depends down into the cavity 19 and is spaced from the inside walls 11*b* and 12*b*.

FIG. 3B discloses the transverse profile of the fin of the present invention, which profile provides a low drag, whereas FIG. 3A shows the transverse profile of the prior art solid fiberglass fin with the high drag effect. The fin of FIG. 3B is also buoyant as compared with the fin of FIG. 3A which tends to overly weigh-down the tail end of the surfboard.

The fin of the present invention is preferably constructed of thermoformed or molded plastic materials and most preferably the polycarbonates such as Lexan and the like. Other plastics particularly those with high impact strength, and good dimensional stability are most preferred.

The contoured fin may be formed from $\frac{1}{8}$ inch Lexan sheet stock which is thermoformed over a mold surface at the working temperature of about 375 degrees F. After thermally working the sheet, the fin members are cooled and trimmed for proper mating and receiving of the surfboard mounting member. The flat head brass screws are inserted, and before final tightening the sealant is applied. With full tightening any excess sealant is trimmed away.

The fin of the present invention is at least about 15% lighter than conventional solid fiberglass fins; and is buoyant as well, whereas the conventional fiberglass fin is not buoyant.

It is to borne in mind that another aspect of the present invention is that the inner surfaces of the translucent members 11 and 12 may be painted or decorated before assembly and provide a decorative fin whereby the decorative material is not subject to wear or damage and remains essentially permanent.

Sealants which may be employed to seal the opposing shaped contoured members of the fin include those well known in the art which provide a fluid-tight seal between abutting plastic surfaces. The preferred sealants include the silicones, and most preferably "Universal Adhesive" manufactured by Universal Sign Corp., West New York, New Jersey 07093, which was found to be effective at temperatures of from −30 degrees F. to 180 degrees F.

Adhesives or glues which may be employed to mount the attachment clip as well as to bond the two pieces of the attaching member are those well known in the adhesives field for bonding plastic surfaces, and a preferred adhesive is "Lexgrip" manufactured by General Electric, Schnectady, New York, which is particularly suited to bonding Lexan surfaces.

While specific embodiments have been described it will be appreciated by one skilled in the art that many modifications may be made therein without departing from the true spirit and scope of the invention.

What I claim is:

1. A surfboard fin consisting of a body formed of molded plastic being formed as a hollow cavity so as to be buoyant, and means connected to the body to join said body to a surfboard; said plastic extending outwardly from said means so as to provide an outwardly extending external contour and fin profile so as to reduce drag on said fin while imparting buoyancy to the surfboard, said outwardly extending plastic being formed with a pair of facingly disposed shoulders disposed on opposite sides of said means, and opposed side members curving downwardly from said shoulders to form said external contour and fin profile.

2. The surfboard fin of claim 1, said body comprising two opposed contoured members and means to join said members.

3. The surfboard fin of claim 2, said means to join said members comprising screw means disposed within said cavity and interconnecting said members.

4. The surfboard fin of claim 3, said members having opposed matching edges and further comprising a sealant disposed at said edges.

5. The surfboard fin of claim 2, said means to join said members comprising one of said members being formed with recessed internal screw threads and the other member being formed with a coaxial bore whereby a screw passes through said bore and into said recessed threads so as to join said members.

6. The surfboard fin of claim 2, said means to join said members further comprising a block connected to said body, said block comprising a tongue to be received in the recess on the underside of a surfboard.

7. The surfboard fin of claim 6, said block being formed so as to receive said means to join said members.

8. The surfboard fin of claim 1, said plastic comprising a polycarbonate.

9. The surfboard fin of claim 1, said body being fluid tight.

10. The surfboard fin of claim 1, wherein said members comprise translucent plastic.

11. The surfboard fin of claim 10, wherein the inside surface of said translucent plastic provides a decoration receiving surface, whereby the decoration is viewable through the translucent plastic.

* * * * *